US007928936B2

(12) United States Patent
Levey et al.

(10) Patent No.: US 7,928,936 B2
(45) Date of Patent: Apr. 19, 2011

(54) ACTIVE MATRIX DISPLAY COMPENSATING METHOD

(75) Inventors: Charles I. Levey, West Henrietta, NY (US); John W. Hamer, Rochester, NY (US)

(73) Assignee: Global OLED Technology LLC, Herndon, VA (US)

( * ) Notice: Subject to any disclaimer, the term of this patent is extended or adjusted under 35 U.S.C. 154(b) by 860 days.

(21) Appl. No.: 11/869,834

(22) Filed: Oct. 10, 2007

(65) Prior Publication Data

US 2008/0122760 A1 May 29, 2008

Related U.S. Application Data

(63) Continuation-in-part of application No. 11/563,864, filed on Nov. 28, 2006, now abandoned.

(51) Int. Cl.
*G09G 3/30* (2006.01)

(52) U.S. Cl. ..... 345/77; 345/76; 345/690; 315/169.3

(58) Field of Classification Search ..... 345/76–82, 345/211, 690, 204
See application file for complete search history.

(56) References Cited

U.S. PATENT DOCUMENTS

| | | | | |
|---|---|---|---|---|
| 6,501,230 | B1 * | 12/2002 | Feldman | 315/169.3 |
| 6,911,781 | B2 * | 6/2005 | Yamazaki et al. | 315/169.3 |
| 7,046,220 | B2 * | 5/2006 | Tagawa et al. | 345/76 |
| 7,224,332 | B2 * | 5/2007 | Cok | 345/76 |
| 7,233,302 | B2 * | 6/2007 | Ishizuka | 345/77 |
| 7,319,444 | B2 * | 1/2008 | Jo | 345/76 |
| 7,345,660 | B2 * | 3/2008 | Mizukoshi et al. | 345/77 |
| 7,479,955 | B2 * | 1/2009 | Yoshida | 345/211 |

FOREIGN PATENT DOCUMENTS

EP 1 480 195 11/2004

OTHER PUBLICATIONS

Goh et al., A New a-Si:H Thin-Film Transistor Pixel Circuit for Active-Matrix Organic Light-Emitting Diodes, IEEE Electron Device Letters, vol. 24, No. 9, pp. 583-585.

J. H. Jung et al., Development of a 14.1 inch Full Color AMOLED Display with Top Emission Structure, IMID 05 Digest, pp. 793-796.

Shahin Jafarabadiashtiani et al., "P-25: A New Driving Method for a-Si AMOLED Displays Based on Voltage Feedback", SID International Symposium, (2005), pp. 316-319.

* cited by examiner

*Primary Examiner* — Duc Q. Dinh

(74) *Attorney, Agent, or Firm* — Morgan, Lewis & Bockius LLP

(57) ABSTRACT

Compensating for changes in the threshold voltage of the drive transistor of an OLED drive circuit, the drive transistor includes a first electrode, second electrode, and gate electrode; connecting a first voltage source to the first electrode, and an OLED device to the second electrode and to a second voltage source; providing a test voltage to the gate electrode and connecting to the OLED drive circuit, a test circuit, that includes an adjustable current mirror causing voltage applied to the current mirror, to be at a first test level; providing a test voltage to the gate electrode of the drive transistor and connecting the test circuit to the OLED device producing a second test level after the drive transistor and the OLED device age; and using the first and second test levels to calculate changes in the voltage applied to the gate electrode of the drive transistor to compensate for drive transistor aging.

21 Claims, 5 Drawing Sheets

ACTIVE MATRIX DISPLAY COMPENSATING METHOD

CROSS-REFERENCE TO RELATED APPLICATIONS

This is a continuation-in-part of commonly-assigned U.S. patent application Ser. No. 11/563,864, filed Nov. 28, 2006, now abandoned entitled "Active Matrix Display Compensation Method" by Charles I. Levey.

FIELD OF THE INVENTION

The present invention relates to an active matrix-type display device for driving display elements.

BACKGROUND OF THE INVENTION

In recent years, it has become necessary that image display devices have high-resolution and high picture quality, and it is desirable for such image display devices to have low power consumption and be thin, lightweight, and visible from wide angles. With such requirements, display devices (displays) have been developed where thin-film active elements (thin-film transistors, also referred to as TFTs) are formed on a glass substrate, with display elements then being formed on top.

In general, a substrate forming active elements is such that patterning and interconnects formed using metal are provided after forming a semiconductor film of silicon, e.g. amorphous silicon or polysilicon. Due to differences in the electrical characteristics of the active elements, the former requires Integrated Circuits (ICs) for drive use, and the latter is capable of forming circuits for drive use on the substrate. In liquid crystal displays (LCDs) currently widely used, the amorphous silicon type is widespread for larger screens, while the polysilicon type is more common in medium and small screens.

Typically, electroluminescent elements, for example organic light-emitting diodes (OLEDs), are used in combination with TFTs and utilize a voltage/current control operation so that current is controlled. The current/voltage control operation refers to the operation of applying a signal voltage to a TFT gate terminal so as to control current between two electrodes, one of which is connected to the OLED. As a result, it is possible to adjust the intensity of light emitted from the organic EL element and to control the display to the desired gradation.

However, in this configuration, the intensity of light emitted by the organic EL element is extremely sensitive to the TFT characteristics. In particular, for amorphous silicon TFTs (referred to as a-Si), it is known that comparatively large differences in electrical characteristics occur with time between neighboring pixels due to changes in transistor threshold voltage. This is a major cause of deterioration of the display quality of organic EL displays, in particular, screen uniformity. Uncompensated, this effect can lead to "burned-in" images on the screen. Additionally, changes in the EL element itself, such as forward voltage rise and efficiency loss, can cause image bum-in.

Goh et al. (IEEE Electron Device Letters, Vol. 24, No. 9, pp. 583-585) have proposed a pixel circuit with a precharge cycle before data loading to compensate for this effect. Compared to the standard OLED pixel circuit with a capacitor, a select transistor, a power transistor, and power, data, and select lines, Goh's circuit uses an additional control line and two additional switching transistors. Jung et al. (IMID '05

Digest, pp. 793-796) have proposed a similar circuit with an additional control line, an additional capacitor, and three additional transistors. While such circuits can be used to compensate for changes in the threshold voltage of the driving transistor, they add to the complexity of the display, thereby increasing the cost and the likelihood of defects in the manufactured product. Further, such circuitry generally comprises thin-film transistors (TFTs) and necessarily uses up a portion of the substrate area of the display. For bottom-emitting devices, where the aperture ratio is important, such additional circuitry reduces the aperture ratio, and can even make such bottom-emitting displays unusable. Thus, there exists a need to compensate for changes in the OLED emitter and in the electrical characteristics of the pixel circuitry in an OLED display without reducing the aperture ratio of such a display.

SUMMARY OF THE INVENTION

It is therefore an object of the present invention to provide a method of compensating for changes in the electrical characteristics of the pixel circuitry in an OLED display.

This object is achieved by a method of compensating for changes in the threshold voltage of the drive transistor of an OLED drive circuit, comprising:

a) providing the drive transistor with a first electrode, a second electrode, and a gate electrode;

b) connecting a first voltage source to the first electrode of the drive transistor, and an OLED device to the second electrode of the drive transistor and to a second voltage source;

c) providing a test voltage to the gate electrode of the drive transistor and connecting to the OLED drive circuit a test circuit that includes an adjustable current mirror that is set to provide a predetermined drive current through the drive transistor and the OLED device and causes the voltage applied to the current mirror to be at a first test level when the drive transistor and the OLED device are not degraded by aging conditions, and storing the first test level;

d) providing a test voltage to the gate electrode of the drive transistor and connecting the test circuit to the OLED device to produce a second test level after the drive transistor and the OLED device have aged, and storing the second test level; and e) using the first and second test levels to calculate a change in the voltage applied to the gate electrode of the drive transistor to compensate for aging of the drive transistor.

ADVANTAGES

It is an advantage of the present invention that it can compensate for changes in the electrical characteristics of the thin-film transistors of an OLED display. It is a further advantage of this invention that it can so compensate without reducing the aperture ratio of a bottom-emitting OLED display and without increasing the complexity of the within-pixel circuits.

DETAILED DESCRIPTION OF THE INVENTION

Figure 1:
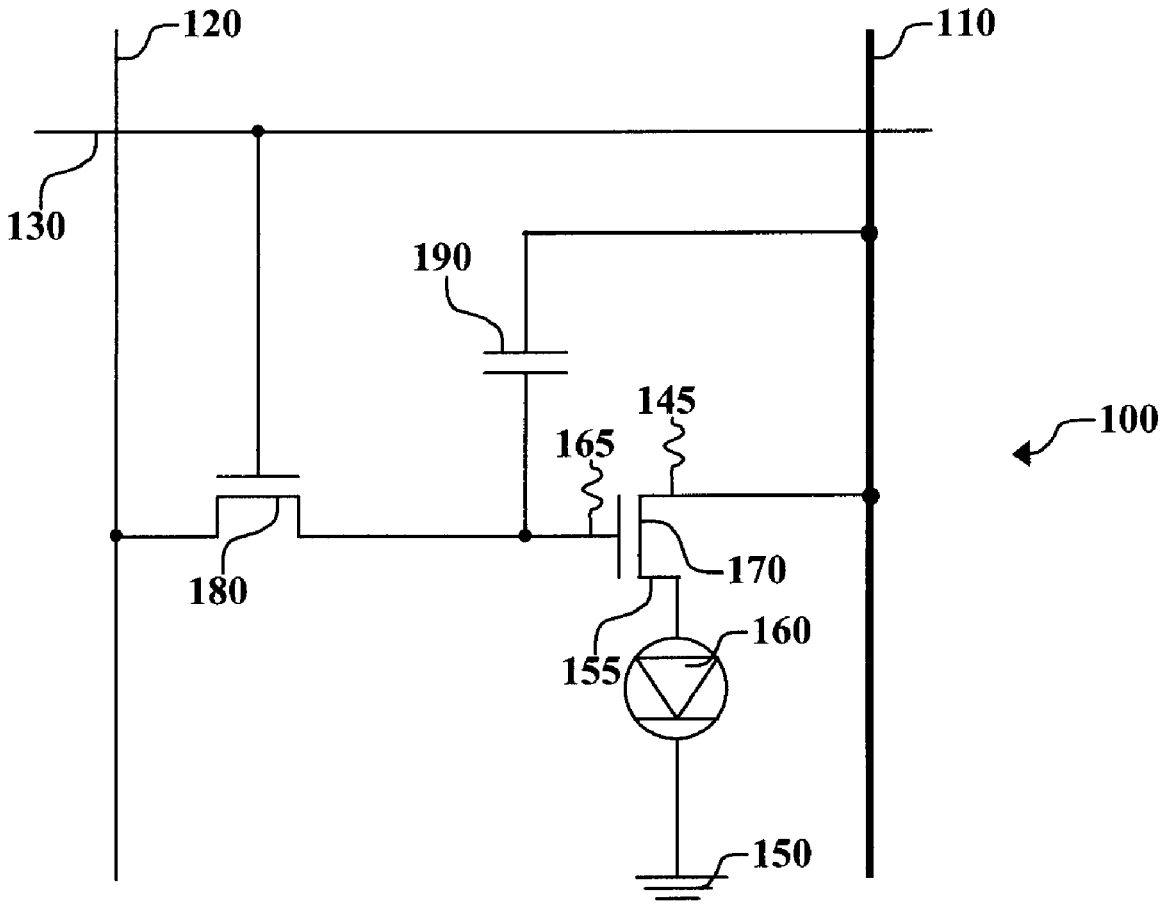
FIG. 1 shows a schematic diagram of one embodiment of an OLED drive circuit that can be used in the practice of this invention.

Turning now to FIG. 1, there is shown a schematic diagram of one embodiment of an OLED drive circuit that can be used in the practice of this invention. Such OLED drive circuits are well known in the art in active matrix OLED displays. OLED pixel drive circuit 100 has a data line 120, a power supply line or first voltage source 110, a select line 130, a drive transistor 170, a switch transistor 180, an OLED device 160 that can be a single pixel of an OLED display, and a capacitor 190. Drive transistor 170 is an amorphous-silicon (a-Si) transistor and has first electrode 145, second electrode 155, and gate electrode 165. First electrode 145 of drive transistor 170 is electrically connected to first voltage source 110, while second electrode 155 is electrically connected to OLED device 160. In this embodiment of pixel drive circuit 100, first electrode 145 of drive transistor 170 is a drain electrode and second electrode 155 is a source electrode. By electrically connected, it is meant that the elements are directly connected or connected via another component, e.g. a switch, a diode, another transistor, etc. OLED device 160 is a non-inverted OLED device, which is electrically connected to drive transistor 170 and to a second voltage source, which is negative relative to the first voltage source. In this embodiment, the second voltage source is ground 150. Those skilled in the art will recognize that other embodiments can utilize other sources as the second voltage source. Switch transistor 180 has a gate electrode electrically connected to select line 130, as well as source and drain electrodes, one of which is electrically connected to the gate electrode 165 of drive transistor 170, while the other is electrically connected to data line 120. OLED device 160 is powered by flow of current between power supply line 110 and ground 150. In this embodiment, the first voltage source (power supply line 110) has a positive potential, relative to the second voltage source (ground 150), to cause current to flow through drive transistor 170 and OLED device 160, so that OLED device 160 produces light. The magnitude of the current—and therefore the intensity of the emitted light—is controlled by drive transistor 170, and more exactly by the magnitude of the signal voltage on gate electrode 165 of drive transistor 170. During a write cycle, select line 130 activates switch transistor 180 for writing and the signal voltage data on data line 120 is written to drive transistor 170 and stored on capacitor 190, which is connected between gate electrode 165 and power supply line 110.

Transistors such as drive transistor 170 of OLED drive circuit 100 have a characteristic threshold voltage ($V_{th}$). $V_{gs}$, the voltage on gate electrode 165 minus the voltage on source electrode 155, must be greater than the threshold voltage to enable current flow between first and second electrodes 145 and 155, respectively. For amorphous silicon transistors, the threshold voltage is known to change under aging conditions, which include placing drive transistor 170 under actual usage conditions, thereby leading to an increase in the threshold voltage. Therefore, a constant signal on gate electrode 165 will cause a gradually decreasing light intensity emitted by OLED device 160. The amount of such decrease will depend upon the use of drive transistor 170; thus, the decrease can be different for different drive transistors in a display. It is desirable to compensate for such changes in the threshold voltage to maintain consistent brightness and color balance of the display, and to prevent image "burn-in" wherein an often-displayed image (e.g. a network logo) can cause a ghost of itself to always show on the active display. Also, there can be age-related changes to OLED device 160, e.g. efficiency loss.

Figure 2:
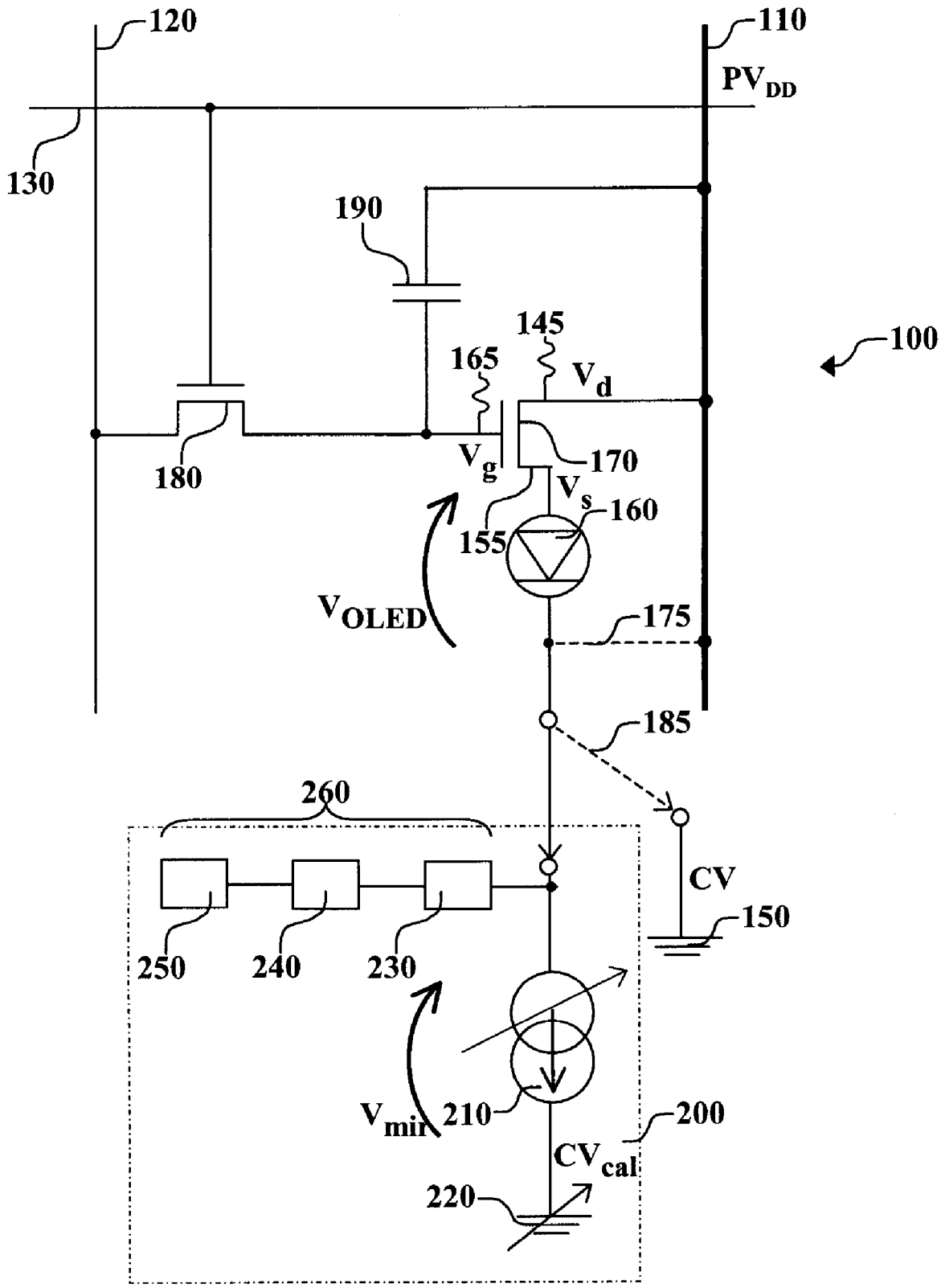
FIG. 2 shows a schematic diagram of the OLED drive circuit of FIG. 1 connected to a test circuit that can be used in the practice of this invention.

Turning now to FIG. 2, there is shown a schematic diagram of the OLED drive circuit 100 of FIG. 1 connected to a test circuit that can be used in the practice of this invention. Test circuit 200 includes an adjustable current mirror 210, a calibrated second voltage source 220, a low-pass filter 230, and an analog-to-digital converter 240. The signal from analog-to-digital converter 240 is sent to processor 250. Low-pass filter 230, analog-to-digital converter 240, and processor 250 comprise measurement apparatus 260. Adjustable current mirror 210 can be set to provide a predetermined drive current through drive transistor 170 and OLED device 160. In this embodiment, adjustable current mirror 210 is an adjustable current sink as known in the art. It will be understood that other embodiments are possible that instead incorporate an adjustable current source. OLED drive circuit 100 can be switched between ground 150 and test circuit 200 by switch 185. When OLED drive circuit 100 is connected to test circuit 200, OLED device 160 is electrically connected to adjustable second voltage source 220.

In the most basic case, test circuit 200 measures a single drive transistor 170 of OLED drive circuit 100. To use test circuit 200, one first sets switch 185 to connect test circuit 200 to OLED drive circuit 100. Next, adjustable current mirror 210 is set to provide the predetermined drive current $I_{mir}$, which is a characteristic current for OLED device 160. $I_{mir}$ is selected to be less than the maximum current possible through drive transistor 170 and OLED device 160; a typical value for $I_{mir}$ will be in the range of 1 to 5 microamps and will generally be constant for all measurements during the lifetime of the OLED device. A test voltage data value $V_{test}$ is provided to gate electrode 165 of drive transistor 170 sufficient to provide a current through drive transistor 170 greater than the selected value for $I_{mir}$. Thus, the limiting value of current through drive transistor 170 and OLED device 160 will be controlled entirely by adjustable current mirror 210, and the current through adjustable current mirror 210 ($I_{mir}$) will be the same as through drive transistor 170 ($I_{ds}$) and OLED device 160 ($I_{OLED}$) ($I_{mir}=I_{ds}=I_{OLED}$, neglecting leakage). The selected value of $V_{test}$ is generally constant for all measurements during the lifetime of the display, and therefore must be sufficient to provide a drive-transistor current greater than $I_{mir}$ even after aging expected during the lifetime of the display. The value of $V_{test}$ can be selected based upon known or determined current-voltage and aging characteristics of drive transistor 170. $CV_{cal}$ is set to allow sufficient voltage adjustment of the current mirror voltage, $V_{mir}$, to maintain $I_{mir}$ when the threshold voltage ($V_{th}$) of drive transistor 170 changes. This value of $CV_{cal}$ will be used for all measurements during the lifetime of the display. The voltages of the components in the circuit can be related by:

$$V_{test}=CV_{cal}+V_{mir}+V_{OLED}+V_{gs} \quad \text{(Eq. 1)}$$

which can be rewritten as:

$$V_{mir}=V_{test}-(CV_{cal}+V_{OLED}+V_{gs}) \quad \text{(Eq. 2)}$$

Under the conditions described above, $V_{test}$ and $CV_{cal}$ are set values. $V_{gs}$ will be controlled by the value of $I_{mir}$ and the current-voltage characteristics of drive transistor 170, and will change with age-related changes in the threshold voltage of drive transistor 170. $V_{OLED}$ will be controlled by the value of $I_{mir}$ and the current-voltage characteristics of OLED device 160. $V_{OLED}$ can change with age-related changes in OLED device 160.

The values of these voltages will cause the voltage applied to current mirror 210 ($V_{mir}$) to adjust to fulfill Eq. 2. This can be measured by measurement apparatus 260 and will be called the test level. To determine the change in the threshold voltage of drive transistor 170 (and the change in $V_{OLED}$, if any), two tests are performed. The first test is performed when drive transistor 170 and OLED device 160 are not degraded by aging, e.g. before OLED drive circuit 100 is used for display purposes, to cause the voltage $V_{mir}$ applied current mirror 210 to be at a first test level. The first test level is measured and stored. After drive transistor 170 and OLED device 160 have aged, e.g. by displaying images for a predetermined time, the measurement is repeated with the same $V_{test}$ and $CV_{cal}$. Changes to the threshold voltage of drive transistor 170 will cause a change to $V_{gs}$ to maintain $I_{mir}$, while changes in OLED device 160 can cause changes to $V_{OLED}$. These changes will be reflected in changes to $V_{mir}$ in Eq. 2, so as to produce voltage $V_{mir}$ at a second test level. The second test level can be measured and stored. The first and second test levels can be used to calculate a change in the voltage applied to current mirror 210, which is related to the changes in the drive transistor and the OLED device as follows:

$$\Delta V_{mir}=-(\Delta V_{OLED}+\Delta V_{gs}) \quad \text{(Eq. 3)}$$

Thus, to compensate for changes due to aging of drive transistor 170 and OLED device 160, a change ($\Delta V_g$) in the voltage $V_g$ to be applied to gate electrode 165 of drive transistor 170 can be calculated as:

$$\Delta V_g=-\Delta V_{mir}=\Delta V_{OLED}+\Delta V_{gs} \quad \text{(Eq. 4)}$$

In more realistic cases, OLED drive circuit 100 is one pixel of a much larger OLED display comprising an array of pixels with a plurality of OLED drive circuits. Each OLED drive circuit includes a drive transistor and an OLED device as described above. Test circuit 200 can measure a single drive transistor 170. This can be accomplished by putting a test voltage ($V_{test}$) on gate electrode 165 of a single drive transistor 170, and setting the gate voltages ($V_g$) for all other drive transistors in a display to zero, thus putting them in the off state. Ideally, current would then flow only through drive transistor 170 and corresponding OLED device 160, and thus the current through adjustable current mirror 210 ($I_{mir}$) would be the same as through drive transistor 170 ($I_{ds}$) and OLED device 160 ($I_{OLED}$), as above. In reality, the drive circuits that are in the off state have a slight current leakage, which can be significant due to the large number of drive circuits in the off state. The leakage current is shown as off-pixel current 175 ($I_{off}$, also known as dark current) in FIG. 2, and is part of the total current through adjustable current mirror 210, that is, $$I_{mir}=I_{OLED}+I_{off} \quad \text{(Eq. 5)}$$

To use test circuit 200 with a plurality of OLED drive circuits, one first sets switch 185 to connect test circuit 200 to the display, including OLED drive circuit 100. $CV_{cal}$ is set such that a negative $V_{gs}$ will be applied to all the drive circuits that are off to reduce the amount of off-pixel current 175. Thus, if $V_g$ for the drive circuits in the off condition is zero volts, $CV_{cal}$ is set to be greater than or equal to zero volts. This value for $CV_{cal}$ will be used for all measurements during the lifetime of the display. Before any individual OLED drive circuit measurements are done, all drive circuits are programmed to the off condition, e.g. $V_g$ is set to zero for all drive circuits, to provide the off-pixel current off for the display. Adjustable current mirror 210 is programmed to the off-pixel current at a selected mirror voltage $V_{mir}$. $V_{mir}$ for the off-pixel current is selected to allow sufficient adjustment in the voltage over the life of OLED drive circuit 100. Typically, $V_{mir}$ for the off-pixel current will be selected in the range of 1 to 6 volts, and this value will be used for all measurements during the lifetime of the display. Next, adjustable current mirror 210 is incremented to allow passage of an additional characteristic current $I_{OLED}$ for a single pixel, e.g. OLED device 160. $I_{OLED}$ is selected as described above; a typical value for $I_{OLED}$ will be in the range of 1 to 5 microamps and will generally be constant for all measurements during the lifetime of the display. A data value $V_{test}$ is written to gate electrode 165 sufficient to provide a current through drive transistor 170 greater than the selected value for $I_{OLED}$. Thus, the limiting value of current through drive transistor 170 and corresponding OLED device 160 will be controlled entirely by adjustable current mirror 210. The value of $V_{test}$ is selected as described above and is generally constant for all measurements during the lifetime of the display. The gate electrodes of all other OLED drive circuits in the display remain at the off value (e.g. zero volts). Eq. 2 can relate the voltages of the components in OLED drive circuit 100.

Under these conditions, $V_{test}$ and $CV_{cal}$ are set values. $V_{gs}$ will be controlled by the value of $I_{OLED}$ and the current-voltage characteristics of drive transistor 170, and will change with age-related changes in the threshold voltage of drive transistor 170. $V_{OLED}$ will be controlled by the value of $I_{OLED}$ and the current-voltage characteristics of OLED device 160. $V_{OLED}$ can change with age-related changes in OLED device 160. The voltage through current mirror 210, $V_{mir}$, will self-adjust to fulfill Eq. 2, above, to be at the test level, which can be measured by measurement apparatus 260. To determine the change in the threshold voltage of drive transistor 170 (and the change in $V_{OLED}$, if any), two tests are performed as described above: a first test when drive transistor 170 and OLED device 160 are not degraded by aging to produce a first test level, and a second after drive transistor 170 and OLED device 160 have aged to produce a second test level. The first and second test levels can be used to calculate a change in the voltage applied to current mirror 210, which is related to the changes in the drive transistor and the corresponding OLED device as shown above in Eq. 3. Thus, to compensate for changes due to aging of drive transistor 170 and corresponding OLED device 160, a change ($\Delta V_g$) in the voltage $V_g$ to be applied to gate electrode 165 of drive transistor 170 can be calculated as shown above in Eq. 4. This can be repeated individually for each drive circuit in the display.

In another embodiment of this method, the test levels can be obtained for a group of drive circuits, e.g. a complete row or column of drive circuits. This would provide an average test level and an average $\Delta V_g$ for each group of drive circuits, but would have the advantage of requiring less time and storage memory for the method.

Figure 3:
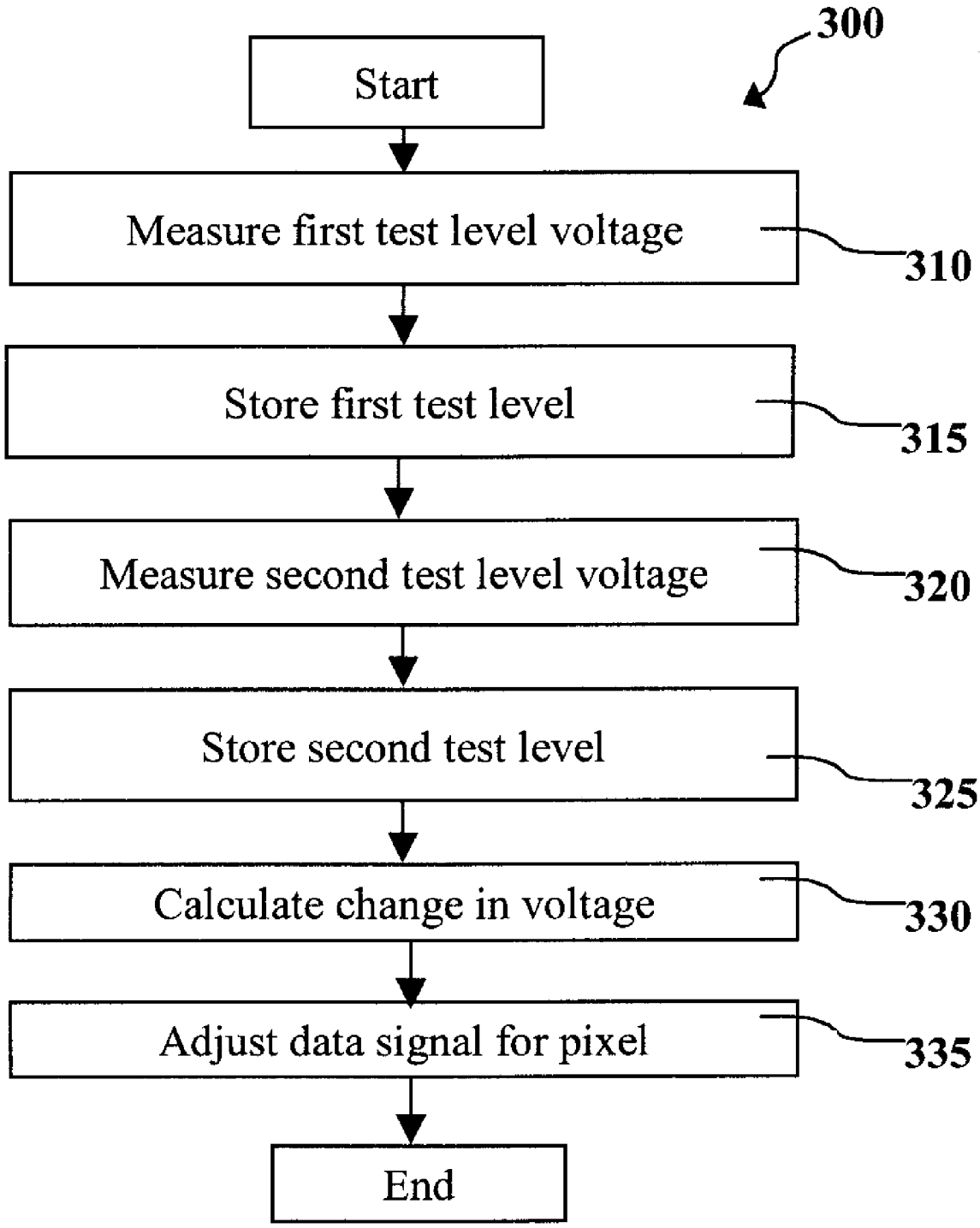
FIG. 3 shows a block diagram of one embodiment of the method of this invention.

Turning now to FIG. 3, and referring to FIG. 2 as well, there is shown a block diagram of one embodiment of the method of this invention. In method 300, the voltage at current mirror 210 for an OLED drive circuit 100, is measured by measurement apparatus 260 (Step 310). This measurement, which is done when drive transistor 170 and OLED device 160 are not degraded by aging conditions, e.g., just after manufacturing the OLED display, or at a time after manufacturing before the OLED display has had significant use, is at a first test level. The first test level is stored by processor 250 (Step 315). After drive transistor 170 and OLED device 160 have aged, the measurement is repeated, to provide a voltage at current mirror 210 at a second test level (Step 320). The second test level is stored by processor 250 (Step 325). Then, processor 250 uses the first and second test levels to calculate a change in the voltage applied to gate electrode 165 of drive transistor 170 to compensate for aging of the drive transistor, as in Eq. 4 above (Step 330). This change in voltage is applied to the voltage at gate electrode 165 to compensate for aging of OLED device 160 and drive transistor 170 (Step 335).

Figure 4:
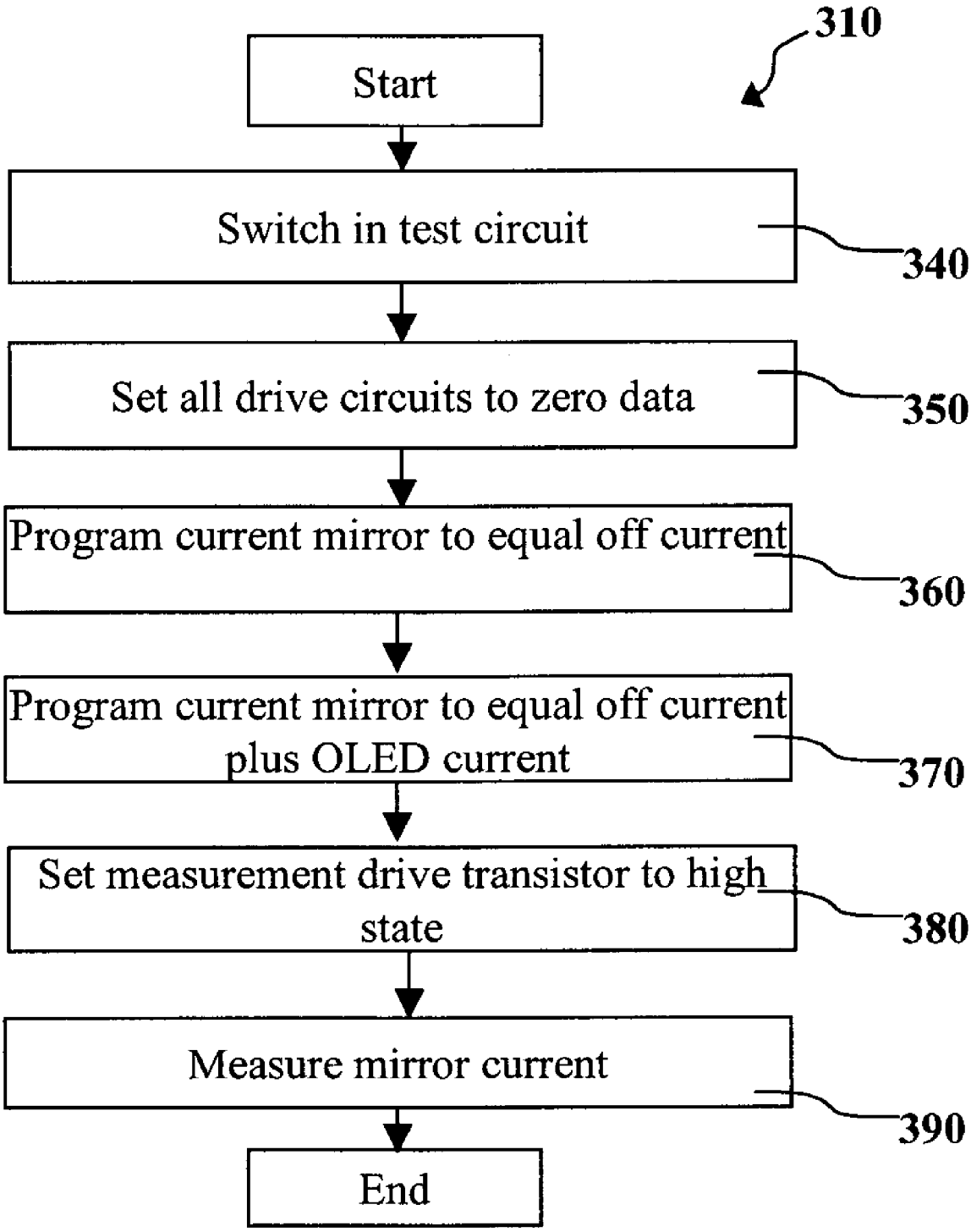
FIG. 4 shows a block diagram of a portion of the method of FIG. 3 in greater detail.

Turning now to FIG. 4, and referring to FIG. 2, as well, there is shown a block diagram of a portion of the method of FIG. 3 in greater detail. FIG. 4 represents individual steps in Step 310 of FIG. 3, as well as Step 320. Initially, switch 185, which is connected to the common cathode of the display, connects OLED drive circuit 100 to test circuit 200 instead of second voltage source 150 (Step 340). Then all drive circuits in the display are programmed as off by setting the data on gate electrode 165 to zero for every OLED drive circuit in the display (Step 350). If the drive transistors 170 were ideal transistors, no current would flow; however, as non-ideal transistors, they do indeed pass some current under these conditions, indicated as off-pixel current 175. Adjustable current mirror 210 is programmed to equal off-pixel current 175 (Step 360); that is, adjustable current mirror 210 is set to pass off-pixel current 175 as its maximum passable current at the selected $V_{mir}$. Then adjustable current mirror 210 is programmed to equal off-pixel current 175 plus the desired current through the individual drive transistor 170 when in the on condition (Step 370). Then drive transistor 170 is set to a high state by placing a data value on gate electrode 165 (Step 380). The data value placed on gate electrode 165 is sufficient to provide a current passing through drive transistor 170 that is greater than the current that will be allowed by adjustable current mirror 210, even when drive transistor 170 has been aged for the expected lifetime of the display. Thus, adjustable current mirror 210 will be the current-limiting apparatus under these conditions. Then the voltage is measured by measurement apparatus 260 (Step 390) to provide the test level. For displays of multiple drive circuits, Steps 380 and 390 can be repeated for each individual drive circuit.

Figure 5:
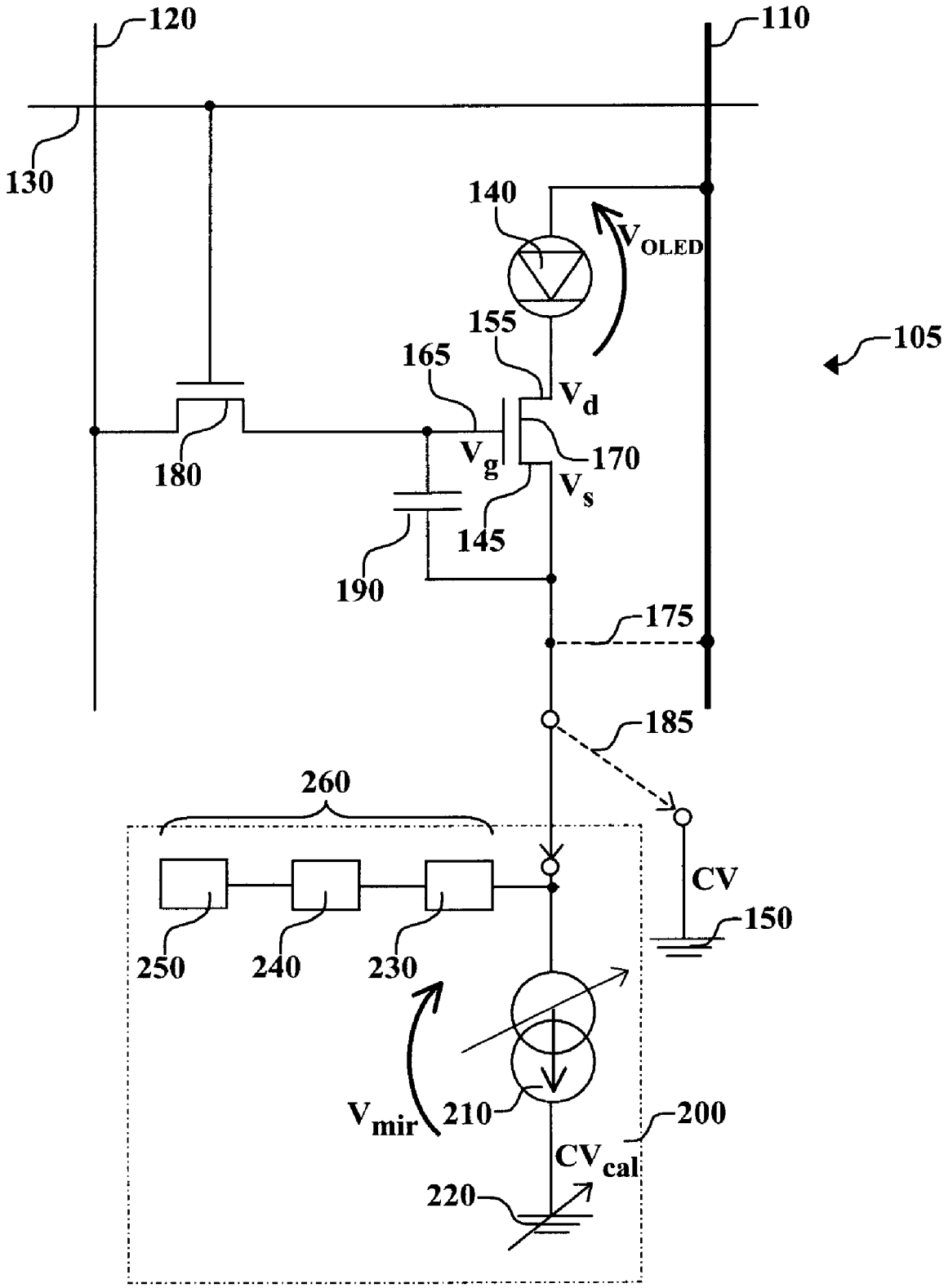
FIG. 5 shows a schematic diagram of another embodiment of a OLED drive circuit connected to a test circuit that can be used in the practice of this invention.

Turning now to FIG. 5, there is shown a schematic diagram of another embodiment of an OLED drive circuit connected to a test circuit that can be used in the practice of this invention. OLED drive circuit 105 is constructed much as OLED drive circuit 100 described above. However, OLED device 140 is an inverted OLED device, wherein the anode of the pixel is electrically connected to power line 110 and the cathode of the pixel is electrically connected to second electrode 155 of drive transistor 170. In this embodiment, first electrode 145 is the source and second electrode 155 is the drain. In the method described above, the voltages between gate electrode 165 and calibrated second voltage source 220 have an effect on the measurement of the test level. Therefore, aging of OLED device 140 will have no effect on the test level measured, and a change in the voltage applied to gate electrode 165 will compensate for aging of drive transistor 170 only. With the method of this invention applied to this embodiment, the voltages of the components in the circuit can be related by:

$$V_{test}=CV_{cal}+V_{mir}+V_{gs} \quad \text{(Eq. 6)}$$

which can be rewritten as:

$$V_{mir}=V_{test}-(CV_{cal}+V_{gs}) \quad \text{(Eq. 7)}$$

The change in voltage at current mirror 210 will then be related as follows:

$$\Delta V_{mir}=-\Delta V_{gs} \quad \text{(Eq. 8)}$$

and the change in the voltage to be applied to gate electrode 165 will be:

$$\Delta V_g=-\Delta V_{mir}=\Delta V_{gs} \quad \text{(Eq. 9)}$$

Turning back to FIG. 2, another embodiment of an OLED drive circuit connected to a test circuit, wherein the OLED drive circuit has a p-channel drive transistor, can be used in the practice of this invention. Note that in general, the test circuit may be connected at any point of the OLED drive circuit on the current path through the drive transistor and OLED device, in order to allow for compensating for aging of a drive transistor of an OLED drive circuit and of an OLED device.

In this embodiment, first electrode 145 can be the source and second electrode 155 can be the drain of a p-channel drive transistor 170, which can be an amorphous silicon transistor. The test circuit is employed as described above.

$V_{test}$ can be selected to bias the drive transistor such that it is operated in the linear regime. In this regime, $V_{ds}$, the difference between the voltage $V_d$ at second electrode 155 and the voltage $V_s$ at first electrode 145, can be independent of $V_{gs}$ and depend only on $I_{ds}$, which is controlled by current mirror 210.

The selected value of $V_{test}$ is generally constant for all measurements during the lifetime of the display, and therefore must be sufficient to provide a drive-transistor current greater than $I_{mir}$ even after aging expected during the lifetime of the display. The value of $V_{test}$ can be selected based upon known or determined current-voltage and aging characteristics of drive transistor 170. $CV_{cal}$ is set as described above.

The voltages of the components in the circuit can be related:

$$PV_{DD}-CV_{cal}=V_{mir}+V_{OLED}+V_{ds} \quad \text{(Eq. 10)}$$

which can be rewritten as:

$$V_{mir}=PV_{DD}-(CV_{cal}+V_{OLED}+V_{ds}) \quad \text{(Eq. 1)}$$

Note that $V_{test}$ does not appear in the equation. Any value of $V_{test}$ which biases the drive transistor to operate in the linear regime can be used. Under the conditions described above, $PV_{DD}$ and $CV_{cal}$ are set values. $V_{ds}$ will be controlled by the value of $I_{mir}$ and the current-voltage characteristics of drive transistor 170, and may change as drive transistor 170 ages. $V_{OLED}$ will be controlled by the value of $I_{mir}$ and the current-voltage characteristics of OLED device 160. $V_{OLED}$ can change with age-related changes in OLED device 160.

The values of these voltages will cause the voltage applied to current mirror 210 ($V_{mir}$) to adjust to fulfill Eq. 11. This can be measured by measurement apparatus 260 and will be called the test level. To determine the change in $V_{OLED}$ and $V_{ds}$, two tests are performed as described above. Thus, to compensate for changes due to aging of the OLED device 160 and drive transistor 170, a change ($\Delta V_g$) in the voltage $V_g$ to be applied to gate electrode 165 of drive transistor 170 can be calculated as described above.

Referring to FIG. 5, in another embodiment, first electrode 145 can be the source and second electrode 155 can be the drain of a p-channel drive transistor 170, which can be an amorphous silicon transistor or LTPS transistor. The OLED test circuit can be attached to the OLED drive circuit at the source 145 of the drive transistor. This is the p-channel dual of the embodiment of FIG. 5. Calibrated second voltage source 220 and second voltage source 150 can have more positive values than first voltage supply 110, current mirror 210 can drive current from source 220 to drive transistor 170, and OLED 140 can have its anode connected to second electrode 155 and its cathode connected to first voltage source 110. In this case, $V_{test}$ can be selected to bias the drive transistor 170 such that is operated in the linear regime. Thus the characteristic equation of the transistor is:

$$I_{ds}=k_p[(V_{gs}-V_{th})V_{ds}-V_{ds}^2/2] \quad \text{(Eq. 12)}$$

(Kano, Kanaan. *Semiconductor Devices*. Upper Saddle River, N.J.: Prentice-Hall, 1998, p. 397, Eq. 13.18). Further, the voltage loop equation for this configuration is:

$$PV_{DD,cal}-CV=V_{mir}+V_{OLED}+V_{ds} \quad \text{(Eq. 13)}$$

wherein $PV_{DD,cal}$ is the voltage supplied to the programmable current mirror and CV is a constant rather than an adjustable voltage. When $V_{gs}$ is sufficiently large to make the $V_{ds}^2/2$ term negligible, and when $V_{th}$ is constant, as it would be for a drive transistor fabricated e.g. in LTPS, equations 12 and 13 can be combined to yield $$V_{oled} = (I_{ds}/(k_p(PV_{DD,\text{cal}} - V_{test} - V_{th} - V_{mir}))) + V_{mir} - (PV_{DD,\text{cal}} - CV) \quad \text{(Eq. 14)}$$

Where $k_p$ is a constant given in Kano, op cit., Eq. 13.17. In this configuration, $PV_{DD,cal}$, CV, $I_{ds}$ and $V_{test}$ are selected values, $V_{th}$ is constant, and $V_{mir}$ is the measured value. Consequently, this configuration can be used to calculate change in the OLED device voltage $V_{oled}$ by measuring $V_{mir}$ and applying Eq. 14.

A useful simplification of Eq. 12 can be $$I_{ds}=k_pV_{ds} \quad \text{(Eq. 15)}$$

when the effect of gate voltage is fairly small, and when the effect of the squared term is fairly small, as described above. In this case, with the conditions given above for deriving Eq. 14, $V_{oled}$ can be expressed as $$V_{oled}=PV_{DD,cal}-CV-V_{mir}-I_{ds}/k_p \quad \text{(Eq. 16)}$$

This simplification is easy to calculate and can be widely applicable.

This approach can be particularly useful on an OLED display comprising a plurality of OLED drive circuits. In this case, the display can comprise multiple groups of drive circuits. A test circuit can be provided for each group. For example, in the case of FIG. 2, the cathode 150 can be quartered, each quarter supplying one-quarter of the OLED drive circuits on the display, and each quarter can have its own test circuit 200. In another example, for the embodiment described above of the p-channel dual of FIG. 5, the more positive bus lines 150, which take the role of $PV_{DD}$ in this case, could be divided into groups, each with its own test circuit. This can be less costly than dividing a sheet cathode. Providing a display comprising multiple groups can advantageously improve readout time and increase S/N ratio by reducing plane capacitance, which resists voltage changes, and crosstalk, which couples noise from one subpixel on to another.

In one embodiment, changes in an OLED drive circuit in an OLED display having two or more groups of drive circuits can be compensated. Changes in either the drive transistor or the OLED device of each drive circuit can be compensated. Each drive circuit is as described above, e.g. as shown in FIG. 2. The OLED drive circuits can be divided into groups and each group can be provided with a corresponding test circuit. For example, as described above, one of the power planes can be split and each side of the split provided with its own test circuit.

In this embodiment, each test circuit can be connected to the OLED drive circuits in the corresponding group. The test procedure can be as for the single-pixel case, e.g. as described above in reference to FIG. 2. The first and second test levels are measured as described above, and those levels used to calculate a change in the voltage applied to the gate electrode of each drive transistor in the group to compensate for aging of each drive circuit. The groups can be measured simultaneously to advantageously decrease readout time. Any individual test circuit can also be multiplexed between the groups; this reduces cost of the test circuit(s) at the expense of longer readout time.

The invention has been described in detail with particular reference to certain preferred embodiments thereof, but it will be understood that variations and modifications can be effected within the spirit and scope of the invention. For example, the above embodiments are constructed wherein the drive transistors and switch transistors are n-type transistors. It will be understood by those skilled in the art, that embodiments wherein the drive transistors and switch transistors are p-type transistors, with appropriate well-known modifications to the circuits, can also be useful in this invention. It will also be understood by those skilled in the art, that this invention can also be employed in embodiments using other well-known 2T1C pixel circuits, such as embodiments in which the capacitor 190 is connected between $V_g$ and a voltage supply other than that shown on the drawings.

| | |
|---|---|
| 100 | OLED drive circuit |
| 105 | OLED drive circuit |
| 110 | first voltage source |
| 120 | data line |
| 130 | select line |
| 140 | OLED device |
| 145 | first electrode |
| 150 | ground |
| 155 | second electrode |
| 160 | OLED device |
| 165 | gate electrode |
| 170 | drive transistor |
| 175 | off-pixel current |
| 180 | switch transistor |
| 185 | switch |
| 190 | capacitor |
| 200 | test circuit |
| 210 | adjustable current mirror |
| 220 | calibrated second voltage source |
| 230 | low-pass filter |
| 240 | analog-to-digital converter |
| 250 | processor |
| 260 | measurement apparatus |
| 300 | method |
| 310 | block |
| 315 | block |
| 320 | block |
| 325 | block |
| 330 | block |
| 335 | block |
| 340 | block |
| 350 | block |
| 360 | block |
| 370 | block |
| 380 | block |
| 390 | block |

The invention claimed is:

1. A method of compensating for changes in the threshold voltage of the drive transistor of an OLED drive circuit, comprising:

a) providing the drive transistor with a first electrode, a second electrode, and a gate electrode;

b) connecting a first voltage source to the first electrode of the drive transistor, and an OLED device to the second electrode of the drive transistor and to a second voltage source;

c) providing a test voltage to the gate electrode of the drive transistor and connecting to the OLED drive circuit a test circuit that includes an adjustable current mirror that is set to provide a predetermined drive current through the drive transistor and the OLED device and causes the voltage applied to the current mirror to be at a first test level when the drive transistor and the OLED device are not degraded by aging conditions, and storing the first test level;

d) providing a test voltage to the gate electrode of the drive transistor and connecting the test circuit to the OLED device to produce a second test level after the drive transistor and the OLED device have aged, and storing the second test level; and e) using the first and second test levels to calculate a change in the voltage applied to the gate electrode of the drive transistor to compensate for aging of the drive transistor.

2. The method of claim 1 wherein the first electrode is the drain, the second electrode is the source, and the OLED device is a non-inverted OLED device.

3. The method of claim 2 wherein the change in voltage applied to the gate electrode also compensates for aging of the OLED device.

4. The method of claim 1 wherein the first electrode is the source, the second electrode is the drain, and the OLED device is an inverted OLED device.

5. The method of claim 1 wherein the drive transistor is an amorphous silicon transistor.

6. The method of claim 5 wherein the drive transistor is an n-type transistor.

7. The apparatus of claim 5 wherein the drive transistor is a p-type transistor.

8. The method of claim 1 wherein the test circuit includes a low-pass filter and an analog-to-digital converter.

9. A method of compensating for changes in the threshold voltage of the drive transistor for an OLED device in a plurality of OLED drive circuits, comprising:

a) including in each drive circuit a drive transistor with a first electrode, a second electrode, and a gate electrode, and connecting a first voltage source to the first electrode of the drive transistor, and an OLED device to the second electrode of the drive transistor and to a second voltage source;

b) connecting a test circuit to the OLED drive circuits, and simultaneously providing individually a test voltage to the gate electrode of each of the drive transistors, and providing the test circuit with an adjustable current mirror that is set to provide a predetermined drive current through the drive transistors and the OLED devices and causes the voltage applied to the current mirror to be at a first test level when the drive transistors and OLED devices are not degraded by aging conditions, and storing the first test level;

c) again connecting the test circuit to the OLED drive circuits and simultaneously providing individually a test voltage to the gate electrode of each of the drive transistors to produce a second test level after the drive transistors and the OLED devices have aged, and storing the second test level; and d) using the first and second test levels to calculate a change in the voltage applied to the gate electrode of each drive transistor to compensate for aging of each drive transistor.

10. The method of claim 9 wherein the first electrode is the drain, the second electrode is the source, and the OLED device is a non-inverted OLED device.

11. The method of claim 10 wherein the change in the voltage applied to the gate electrode of each drive transistor also compensates for the aging of the corresponding OLED device.

12. The method of claim 9 wherein the first electrode is the source, the second electrode is the drain, and the OLED device is an inverted OLED device.

13. The method of claim 9 wherein the drive transistor is an amorphous silicon transistor.

14. The method of claim 13 wherein the drive transistor is an n-type transistor.

15. The apparatus of claim 13 wherein the drive transistor is a p-type transistor.

16. The method of claim 9 wherein the test circuit includes a low-pass filter and an analog-to-digital converter.

17. A method of compensating for aging of a drive transistor of an OLED drive circuit and of an OLED device, comprising:

a) providing the drive transistor with a first electrode, a second electrode, and a gate electrode;

b) connecting a first voltage source to the first electrode of the drive transistor, and an OLED device to the second electrode of the drive transistor and to a second voltage source;

c) providing a test voltage to the gate electrode of the drive transistor and connecting to the OLED drive circuit a test circuit that includes an adjustable current mirror that is set to provide a predetermined drive current through the drive transistor and the OLED device and causes the voltage applied to the current mirror to be at a first test level when the drive transistor and the OLED device are not degraded by aging conditions, and storing the first test level;

d) providing a test voltage to the gate electrode of the drive transistor and connecting the test circuit to the OLED drive circuit to produce a second test level after the drive transistor and the OLED device have aged, and storing the second test level; and e) using the first and second test levels to calculate a change in the voltage applied to the gate electrode of the drive transistor to compensate for aging of the drive transistor and of the OLED device.

18. The method of claim 17, wherein the drive transistor is a p-type transistor, the first electrode is the source, the second electrode is the drain, and the OLED device is a non-inverted OLED device.

19. The method of claim 17 wherein the drive transistor is an amorphous silicon transistor.

20. The method of claim 17, wherein the drive transistor is operated in the linear regime while the test circuit is connected to the OLED drive circuit.

21. A method of compensating for changes in an OLED drive circuit in an OLED display having two or more groups of drive circuits, comprising:

a) providing in each drive circuit a drive transistor with a first electrode, a second electrode, and a gate electrode, and connecting a first voltage source to the first electrode of the drive transistor, and an OLED device to the second electrode of the drive transistor and to a second voltage source;

b) providing for each group of OLED drive circuits a corresponding test circuit;

c) connecting a test circuit to the OLED drive circuits in the corresponding group, and simultaneously providing individually a test voltage to the gate electrode of each of the drive transistors in that group, and providing the test circuit with an adjustable current mirror that is set to provide a predetermined drive current through the drive transistors and the OLED devices and causes the voltage applied to the current mirror to be at a first test level when the drive transistors and OLED devices are not degraded by aging conditions, and storing the first test level;

d) again connecting the test circuit to the OLED drive circuits in the corresponding group and simultaneously providing individually a test voltage to the gate electrode of each of the drive transistors in that group to produce a second test level after the drive transistors and the OLED devices have aged, and storing the second test level; and e) using the first and second test levels to calculate a change in the voltage applied to the gate electrode of each drive transistor in the group to compensate for aging of each drive circuit.

* * * * *